US006612035B2

(12) United States Patent
Brown et al.

(10) Patent No.: US 6,612,035 B2
(45) Date of Patent: Sep. 2, 2003

(54) DRYWALL CUTTING TOOL

(76) Inventors: Patrick H. Brown, 230 Nelson La., Rickman, TN (US) 38580; William D. Good, 7 Iowa Ave., Lake Hopatcong, NJ (US) 07849

( * ) Notice: Subject to any disclaimer, the term of this patent is extended or adjusted under 35 U.S.C. 154(b) by 17 days.

(21) Appl. No.: 09/745,408

(22) Filed: Dec. 26, 2000

(65) Prior Publication Data

US 2001/0029673 A1 Oct. 18, 2001

Related U.S. Application Data

(60) Provisional application No. 60/174,603, filed on Jan. 5, 2000.

(51) Int. Cl.[7] ..... B26B 29/00

(52) U.S. Cl. ..... 30/292; 30/294; 30/287; 83/745

(58) Field of Search ..... 83/745, 614; 30/293, 30/294, 287, 289, 292, 314, 299; 33/485

(56) References Cited

U.S. PATENT DOCUMENTS

| | | | | | |
|---|---|---|---|---|---|
| 2,466,357 | A | * | 4/1949 | Beith | 33/833 |
| 2,835,037 | A | * | 5/1958 | Middents | 33/485 |
| 3,174,225 | A | * | 3/1965 | Abraham | 30/287 |
| 3,286,351 | A | * | 11/1966 | McAlister | 30/293 |
| 3,439,426 | A | * | 4/1969 | Wilson | 30/164.95 |
| 4,128,030 | A | * | 12/1978 | Kundikoff | 33/429 |
| 4,158,977 | A | * | 6/1979 | Logan | 30/293 |
| 4,176,572 | A | * | 12/1979 | Pennington | 144/1.1 |
| 4,589,207 | A | * | 5/1986 | Loth et al. | 30/287 |
| 4,646,439 | A | * | 3/1987 | Squires | 30/289 |
| 4,866,847 | A | * | 9/1989 | Batrack et al. | 30/293 |
| 4,868,989 | A | * | 9/1989 | Renaud | 30/293 |
| 4,903,409 | A | * | 2/1990 | Kaplan et al. | 30/293 |
| 4,949,462 | A | * | 8/1990 | Spencer | 30/293 |
| 4,956,919 | A | | 9/1990 | Granger | |
| 4,979,304 | A | * | 12/1990 | Sprague | 30/293 |
| 5,050,306 | A | * | 9/1991 | Renaud | 30/293 |
| 5,083,375 | A | | 1/1992 | Helm, Sr. | |
| 5,231,764 | A | | 8/1993 | Chang | |
| 5,265,342 | A | | 11/1993 | Lang, Jr. | |
| 5,471,753 | A | | 12/1995 | Rodrigues | |
| 5,542,184 | A | * | 8/1996 | Beard | 30/293 |
| D376,988 | S | | 12/1996 | Bruno | |
| 5,600,892 | A | | 2/1997 | Peugh et al. | |
| 5,720,104 | A | | 2/1998 | Decker | |
| 5,732,472 | A | * | 3/1998 | Praye | 30/293 |
| 5,815,931 | A | * | 10/1998 | Cleveland | 30/293 |
| D406,537 | S | | 3/1999 | Sharp | |
| 5,996,237 | A | * | 12/1999 | Sanders | 30/293 |
| 6,430,817 | B2 | * | 8/2002 | Hoffman | 30/293 |
| 6,467,174 | B1 | * | 10/2002 | Kotori | 30/292 |

FOREIGN PATENT DOCUMENTS

| | | |
|---|---|---|
| GB | 111579 | 12/1917 |
| GB | 2203839 | 10/1988 |
| IT | 513079 | 2/1955 |

* cited by examiner

*Primary Examiner*—Allan N. Shoap
*Assistant Examiner*—Jason Prone
(74) *Attorney, Agent, or Firm*—Richard C. Litman

(57) ABSTRACT

A drywall cutting tool provides cuts in drywall material either parallel or perpendicular to a reference edge of the sheet, without repositioning the tool from the reference edge. The tool comprises a T square, with the head and stem portions immovably affixed to one another. The stem of the tool carries a slidably adjustable cutting body thereon, with the cutting body being secured through an elongate slot formed in the center of the stem portion of the device. The cutting body carries a pair of spaced apart cutting rollers or discs, and may be turned so the cutting axes of the two discs define a line either parallel or perpendicular to the reference edge of the sheet, and thus perpendicular or parallel to the stem of the tool.

19 Claims, 4 Drawing Sheets

DRYWALL CUTTING TOOL

CROSS-REFERENCE TO RELATED APPLICATION

This application claims the benefit of U.S. Provisional Patent Application Ser. No. 60/174,603, filed Jan. 5, 2000.

BACKGROUND OF THE INVENTION

1. Field of the Invention

The present invention relates generally to hand tools for cutting various articles, and more specifically to a cutting tool including guide means for cutting or scoring across the length and width of a drywall sheet or board. The present tool includes an adjustably installable cutting blade body for installation on a guide in one of two mutually normal orientations to permit cutting or scoring in two mutually perpendicular axes.

2. Description of the Related Art

The use of gypsum wallboard or drywall has become the most common means of finishing the interior structure of most building structures. The installation and finishing of drywall boards or panels takes relatively little time for experienced workers, and provides a smooth surface for further finishing. Cutting drywall panels to size remains one of the more labor intensive aspects of working with the material, due to the different tools generally used in the measuring, marking, and cutting operations.

Generally, the cutting of drywall panels to any given shape or size involves about the same number of steps and time, with the panel being measured and marked for the cut, a straightedge aligned with the mark(s), and a separate cutting or scoring tool being drawn along the mark, as guided by the straightedge. The board is then broken along the scored line to separate the core material along the scored line, and the uncut backing paper is cut through to separate the two panels. This procedure is applicable to both non-rectangular and rectangular panels.

Yet, due to the rectangular configuration of most interior walls and surfaces, most drywall panel cuts are orthogonal and result in rectangular panels of various sizes. Even though forming such rectangular panels should be a relatively straightforward process, the same relatively involved procedure is used as for other panel shapes, resulting in considerable time spent on relatively simple configurations. Also, when the interior of a structure is constructed, the walls are nearly universally a single predetermined height. If this height is different than the length of a standard drywall panel, then the panel must be cut (or an additional piece added) to complete the coverage of the wall. It will be seen that each panel must be cut exactly the same, yet the measuring and cutting process conventionally involves the same number of steps and time for each cut, as for a series of different cuts to form different sizes and shapes of panels. The time spent conventionally in making a series of identically configured panels, adds considerably to the time and expense required for such work.

Accordingly, a need arises for a drywall cutting tool which simplifies the layout of orthogonal cuts to drywall panels. The present tool essentially comprises a T square, with the elongate blade of the square always remaining parallel and perpendicular to the edges of the rectangular board when the crossmember is aligned along one edge. The removable cutting body may be turned in one of two mutually orthogonal directions (four positions), so that the cutting blades are always aligned parallel and perpendicular to the edges of the board, thus guaranteeing a straight and true cut every time. The present tool requires only measuring and marking the board and properly aligning the guide, with the present tool being used for both measuring and guiding the cutting or scoring blade.

A discussion of the related art of which the present inventor is aware, and its differences and distinctions from the present invention, is provided below.

U.S. Pat. No. 4,956,919 issued on Sep. 18, 1990 to James P. Granger, titled "Drywall T-Square," describes a device which is not strictly a T-square, due to the relative movement and disassembly of the two blades from one another. One rule is fixed relative to the drywall panel, with a second relatively movable rule having a series of lateral slots therethrough. A conventional utility knife is inserted through the desired slot and the movable rule is drawn over the panel, with the slot through which the knife blade extends, acting as a guide. The knife used with the Granger guide cannot be positioned for orthogonal cuts; the entire assembly must be repositioned along a perpendicular edge of the board.

U.S. Pat. No. 5,083,375 issued on Jan. 28, 1992 to Larry Helm, Sr., titled "Drywall Cutting Device," describes a T-square like device in which the lower portion of the stem of the device may telescope for extension as required. Two separate tracks are provided, with the cutting head being slidably affixed to the two tracks of the extension and extending thereacross. The device uses a single conventional knife blade, rather than the spaced apart dual roller blades of the present drywall cutting tool. The Helm, Sr. tool is relatively flexible in comparison to the present tool, due to the relatively narrow telescoping arms of the Helm, Sr. tool and their spacing. The positioning of the cutting elements of the present tool outside the channel of the stem portion of the T, results in greater rigidity and more accuracy in forming a cut.

U.S. Pat. No. 5,231,764 issued on Aug. 3, 1993 to Kenneth Chang, titled "Cutter For A Plasterboard Sheet," describes a cutting device which clamps removably to a conventional T-square. The device is relatively simple, and thus has many limitations in comparison to the present drywall cutting tool. The knife holding body secures to the stem of the T-square in only one direction, with the knife blade always oriented normal to the stem of the square. Thus, the Chang device must be moved to a perpendicular second edge of the drywall sheet or board, in order to make a cut parallel to that edge or perpendicular to the first edge. Only a single conventional utility or drywall knife blade is provided by Chang, as compared to the dual spaced apart roller cutting elements of the present drywall cutting tool invention.

U.S. Pat. No. 5,265,342 issued on Nov. 30, 1993 to Joseph D. Lang, Jr., titled "Drywall Cutting Tool," describes a device having a relatively short edge guide for sliding placement along one edge of a drywall sheet, with a rod adjustably extending from the guide. A cutting tool is secured to the end of the rod. The relatively short edge guide permits the guide to rock at least slightly, thus resulting in the cutting tool holding rod moving arcuately somewhat relative to the guide edge of the drywall sheet. The cutting tool cannot be rotated relative to its attachment to the rod. All cuts are made parallel to the movement of the guide along one edge of the board, thus requiring the tool to be moved to a perpendicular edge of the board for a cut perpendicular to the first edge. Only a single conventional cutting blade is provided.

U.S. Pat. No. 5,471,753 issued on Dec. 5, 1995 to Bernardo M. Rodrigues, titled "Combination T-Square And Cutter," describes a square with a stem blade having a relatively wide slot along its center, with a knife holder adjustably riding in the slot. The holder cannot be turned ninety degrees in the slot, due to the provision of locking extensions only in opposite edges of the holder, which engage cooperating notches on each side of the slot of the stem of the square (column 2, lines 44–47). Thus, the device is only capable of making cuts perpendicular to the slotted stem portion of the device; the entire device must be relocated for perpendicular cuts. Moreover, the device includes only an open saddle for holding the knife, with the operator being required to hold the knife in place, unlike the present invention.

U.S. Pat. No. 5,600,892 issued on Feb. 11, 1997 to Glenn H. Peugh et al., titled "Dual Side Drywall Panel Cutter," describes a tool in which dual opposed arms extend downwardly from a single edge guide component, with each arm carrying a cutting blade. The device provides simultaneous cutting of the backing on opposite sides of wallboard material, when the two blades are positioned directly opposite one another. The cutting plane of the blades is fixed normal to the elongate axes of the two arms, and cannot be turned to make a cut parallel to the arms, as provided by the present cutting tool invention. While dual blades are provided by Peugh et al., they are on opposite sides of the sheet, rather than providing dual scoring action on a single side of the sheet.

U.S. Pat. No. 5,720,104 issued on Feb. 24, 1998 to Mark Decker, titled "Drywall Sheet Trimmer," describes a relatively complex device providing simultaneous cutting on opposite sides of a sheet, somewhat like the device of the Peugh et al. '892 U.S. patent discussed immediately above. The Decker device uses a complex rack and pinion mechanism for positioning the cutting elements relative to the edge of the sheet, as Decker uses the device only as a trimmer for trimming the edges of the panels, rather than for making cuts spaced well away from the edges, as provided by the present invention. The Decker device is impractical for such widely spaced cuts, due to the time required to readjust the rack and pinion mechanism over a relatively large distance. The orientation of the cutting blades is fixed relative to the slide, unlike the present drywall tool.

U.S. Pat. No. D-376,988 issued on Dec. 31, 1996 to Anthony T. Bruno, titled "Combination Cutting Gauge And Guide," illustrates a generally L-shaped square, with the two legs of the design being fixed relative to one another. An arcuately movable arm is apparently depicted, but no slidably adjustable cutting tool body nor cutting blade means is shown. The design does not appear to be capable of making cuts parallel and perpendicular to a given edge of a board, at least at any of a series of different distances from that edge, as can the present invention.

U.S. Pat. No. D-406,537 issued on Mar. 9, 1999 to Merle L. Sharp, titled "Drywall Cutting Guide," illustrates a pair of mirror image embodiments, with each comprising a long pole with a handle normal thereto and a knife carrier attached to one end of the pole. No means of securing the device to hold it parallel or perpendicular to one edge of a drywall sheet, is apparent from the drawings of the Sharp design patent.

British Patent Publication No. 111,579 accepted on Dec. 6, 1917 to Peter Milliken, titled "Improvements In Instruments For Geometrical Drawing," describes a T square device with a slidably adjustable guide along the stem of the T. Holes are provided in the head of the T and in one side of the guide for a pencil or marking instrument, but no means is provided for the attachment or holding of a cutting blade or blades. In any event, the side view clearly shows that the stem and head of the T are coplanar with one another, and thus there is no way to hook the head of the T along the edge of a board, as is required with the present cutting tool.

Italian Patent Publication No. 513,079 published on Feb. 3, 1955 to Carlo Simonetta illustrates an elongate rule having an adjustably positionable roller and a cutting blade carrier or body affixed to one end thereof. No crossmember or head normal to the rule is provided, for holding the rule in a perpendicular orientation to one edge of the board for making a cut parallel or perpendicular thereto, as provided by the present cutting tool. Moreover, no means is apparent for turning the tool to make cuts parallel to the rule, as provided by the present invention.

Finally, British Patent Publication No. 2,203,839 published on Oct. 26, 1988 to Ture A. Ljungberg et al., titled "Combination Of A Measuring Tool And A Sharp-Edged Tool," describes a method of securing a conventional drywall or utility knife to a conventional retractable tape measure, by inserting the hook end of the tape into the gap between the handle and blade of the knife. No cross head is provided for holding the device perpendicular or parallel to one edge of a sheet of material, and in any event, the flexible tape does not provide the required rigidity of the present cutting tool. Moreover, no means is provided for adjustably positioning the cutting tool at any point along the tape other than at its extreme end, whereas the cutting body of the present tool is adjustably positionable and may be turned ninety degrees relative to the rule to which it is secured, for parallel and perpendicular cuts.

None of the above inventions and patents, either singly or in combination, is seen to describe the instant invention as claimed.

SUMMARY OF THE INVENTION

The present invention comprises a drywall cutting tool for making cuts parallel or perpendicular to a reference edge of the drywall sheet or board, without repositioning the tool to a second edge for the second cut. The present tool essentially comprises a T square type instrument, with the head or crossmember and the stem of the T being immovably affixed to one another. A cutting blade body is slidably affixed to the stem of the T, through an elongate slot in the stem. A mechanism is provided for turning the cutting body relative to the stem, so the two roller blade cutting elements are either parallel or perpendicular to the stem, as desired.

For making a cut parallel to the reference edge along which the head of the T is resting, the cutting body is turned so the blades are parallel to the T head and locked to the stem at the desired distance from the head to produce a cut along the desired line. The entire assembly is then slid across the sheet with the head of the T acting as a guide along the reference edge of the sheet or board, to produce the desired cut.

For cuts perpendicular to the head of the tool and reference edge of the board, the cutting body is turned so the blades are parallel to the stem of the tool, i.e., perpendicular to the crossmember or head, and the body is loosened in the slot of the stem. The tool is positioned with the cutting blades along the desired cutting line and held immovably in place relative to the board, and the cutting body is slid along the stem of the tool to produce the desired cut.

Accordingly, it is a principal object of the invention to provide an improved drywall cutting tool for forming cuts in drywall sheet material, either parallel or perpendicular to a reference edge of the material along which the tool is placed.

It is another object of the invention to provide an improved drywall cutting tool essentially comprising a T square, with a head serving as a guide for the tool along a reference edge of a drywall panel and with a stem immovably affixed to the head of the T.

It is a further object of the invention to provide an improved drywall cutting tool which stem includes a cutting element body slidably affixed thereto, through an elongate slot in the stem.

An additional object of the invention is to provide an improved drywall cutting tool which cutting body is adjustably positionable relative to the stem portion of the tool, to position the cutting axis of the cutting body either perpendicular or parallel to the reference edge of the drywall sheet as desired.

Still another object of the invention is to provide an improved drywall cutting tool which cutting body includes a pair of spaced roller cutting blades, with the two blades straddling the stem of the tool when cuts parallel to the reference edge are made.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
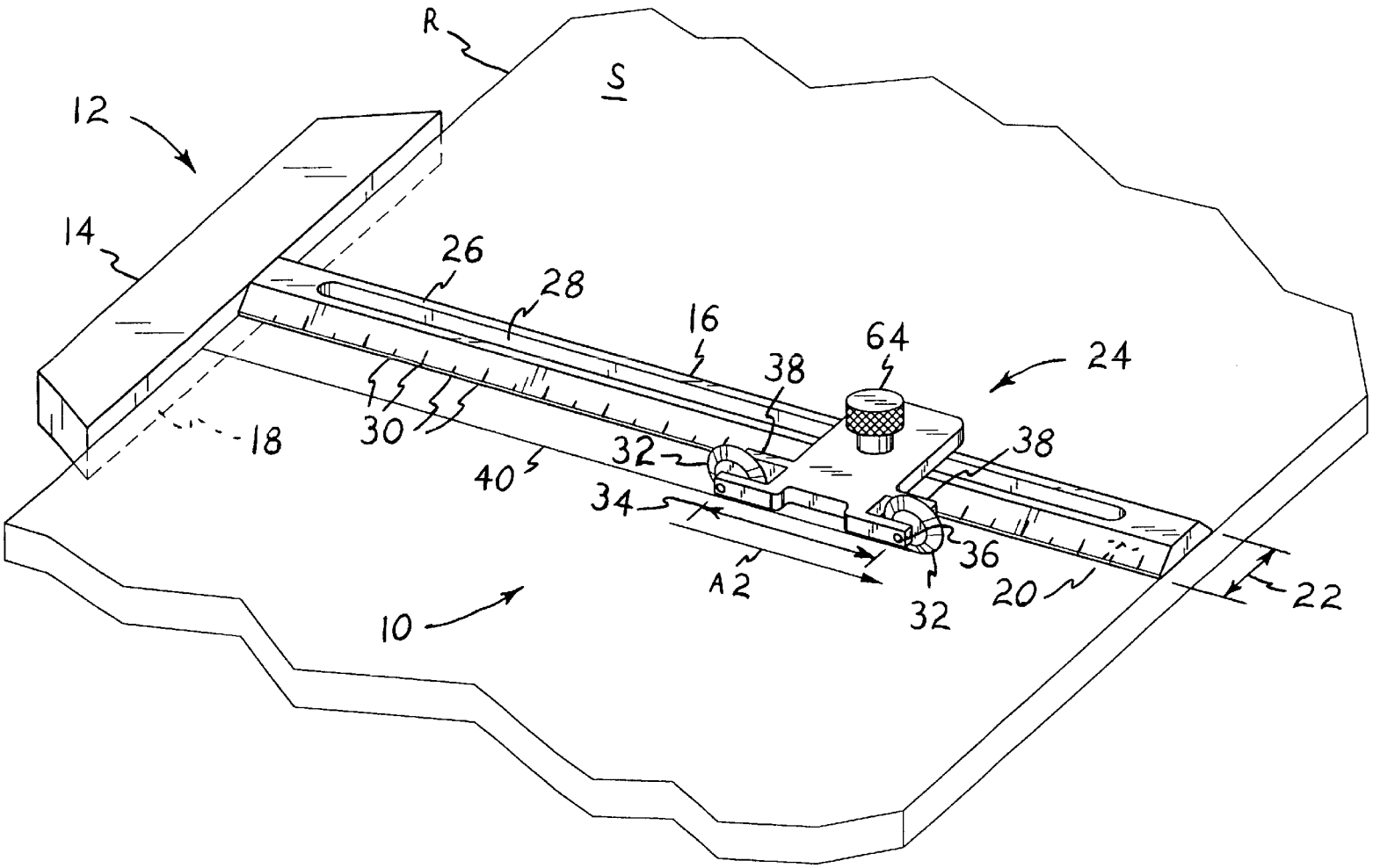
FIG. 1 is an environmental perspective view of the present drywall cutting tool in use, cutting or scoring a drywall sheet perpendicular to the reference edge thereof.
Figure 2:
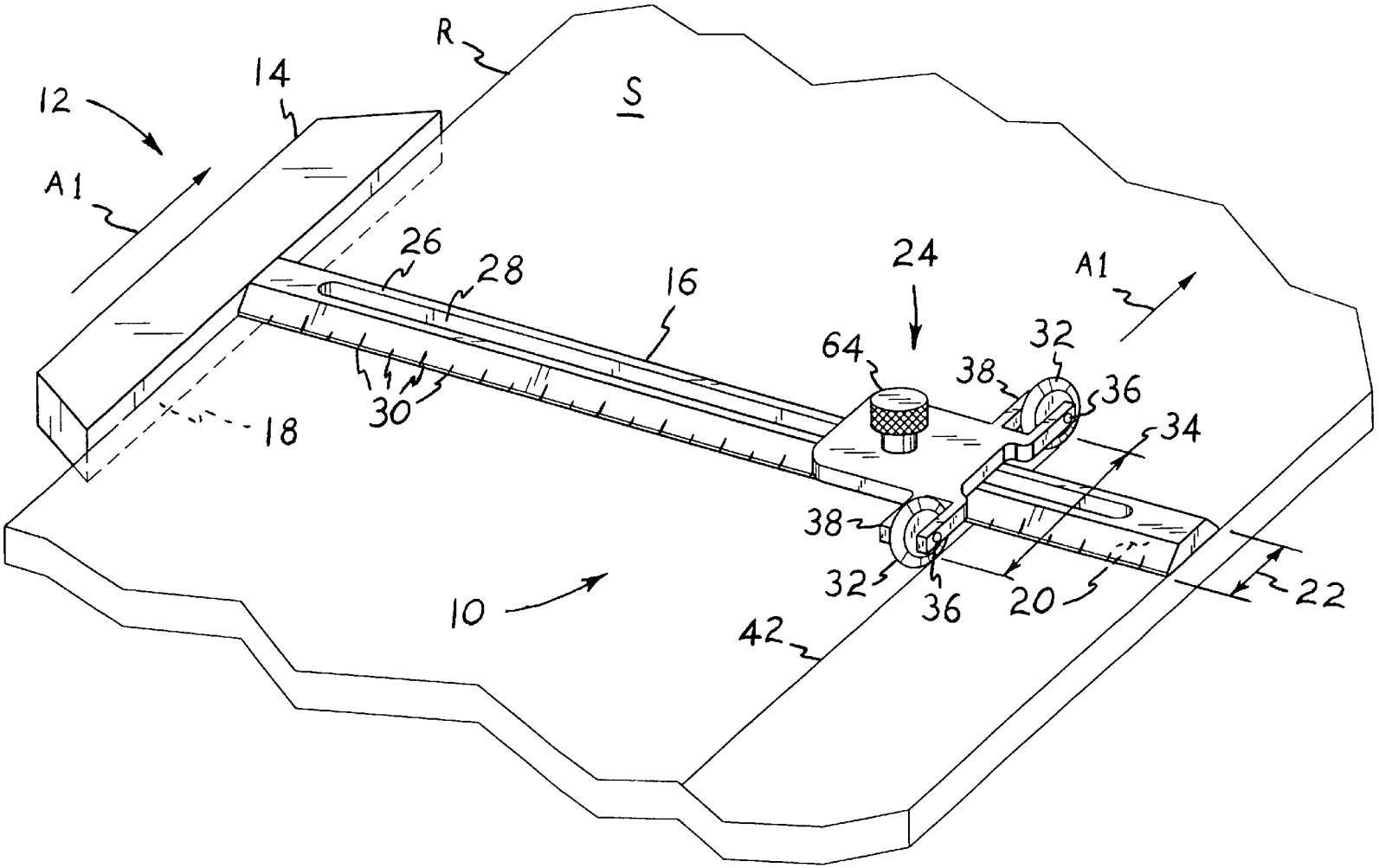
FIG. 2 is an environmental perspective view of the present tool in use, cutting or scoring a drywall sheet parallel to the reference edge.

The present invention comprises a drywall cutting tool, for making cuts parallel or perpendicular to a reference edge of a drywall (gypsum wallboard) sheet. FIGS. 1 and 2 of the present disclosure illustrate the use of the present tool, designated by the reference numeral 10 throughout the drawings. The tool 10 essentially comprises a T square portion 12 having a head or crossmember element 14 with an elongate stem or blade 16 normal to the crossmember extending generally medially therefrom and permanently and immovably affixed thereto.

The T square portion 12 of the tool 10 is adapted to engage one edge of a drywall sheet S, as shown in FIGS. 1 and 2 of the drawings. Accordingly, the head or crossmember portion 14 has a guide edge 18 which depends below the bottom surface 20 of the stem portion 16 of the square 12, for engaging a reference edge R of the sheet S. Thus, the stem portion 16 of the square 12 extends across at least a portion of the drywall sheet S, with the guide edge 18 of the crossmember portion 14 securing the stem portion 16 of the square 12, perpendicular to the reference edge R of the sheet S. This permits the entire tool 10 to be slid or repositioned across the surface of the drywall sheet S as desired, with the blade or stem portion 16 of the tool 10 always remaining perpendicular to the reference edge R of the sheet S, generally as shown by the movement arrows A1 in FIG. 2 of the drawings.

The stem portion 16 of the tool 10 has a width 22 which provides the required lateral stiffness for the stem 16, in order to preclude lateral bending or deflection when the cutting body 24 is drawn therealong to make a cut. The center area 26 of the stem 16 includes an elongate slot 28 formed therethrough, with the slot 28 providing for the removable and adjustable attachment of the cutting body 24 to the stem 16 of the tool 10. The stem 16 may also include graduation marks 30 disposed therealong, if so desired, for providing measurement of cuts to be made using the present tool 10, etc. While the graduations 30 are shown only along one edge of the stem or blade 16, it will be seen that they may be applied to either or both edges, if so desired.

The cutting body 24 includes at least one drywall cutting element 32 extending therefrom, with there preferably being a pair of such elements 32 separated by a span 34 somewhat greater than the width 22 of the stem or blade 16, in order that the cutting body 24 and cutting elements 32 may straddle the stem 16 as shown in FIG. 2 when disposed across the stem 16, to provide even cutting pressure on each side of the stem 16 and avoid asymmetric forces which may lead to distortion of the cut. The two cutting elements 32 are preferably circular or rotary, and ride on axles 36 disposed within opposed bifurcated arms 38 extending from opposite sides of the cutting body 24. The two cutting elements 32 are mutually coplanar, and define a single cutting plane, with the cutting plane being illustrated by the first cutting line 40 which is parallel to the stem or blade 16, as shown in FIG. 1 of the drawings, and by the second cutting line 42 which is perpendicular to the stem 16, as shown in FIG. 2.

Figure 3:
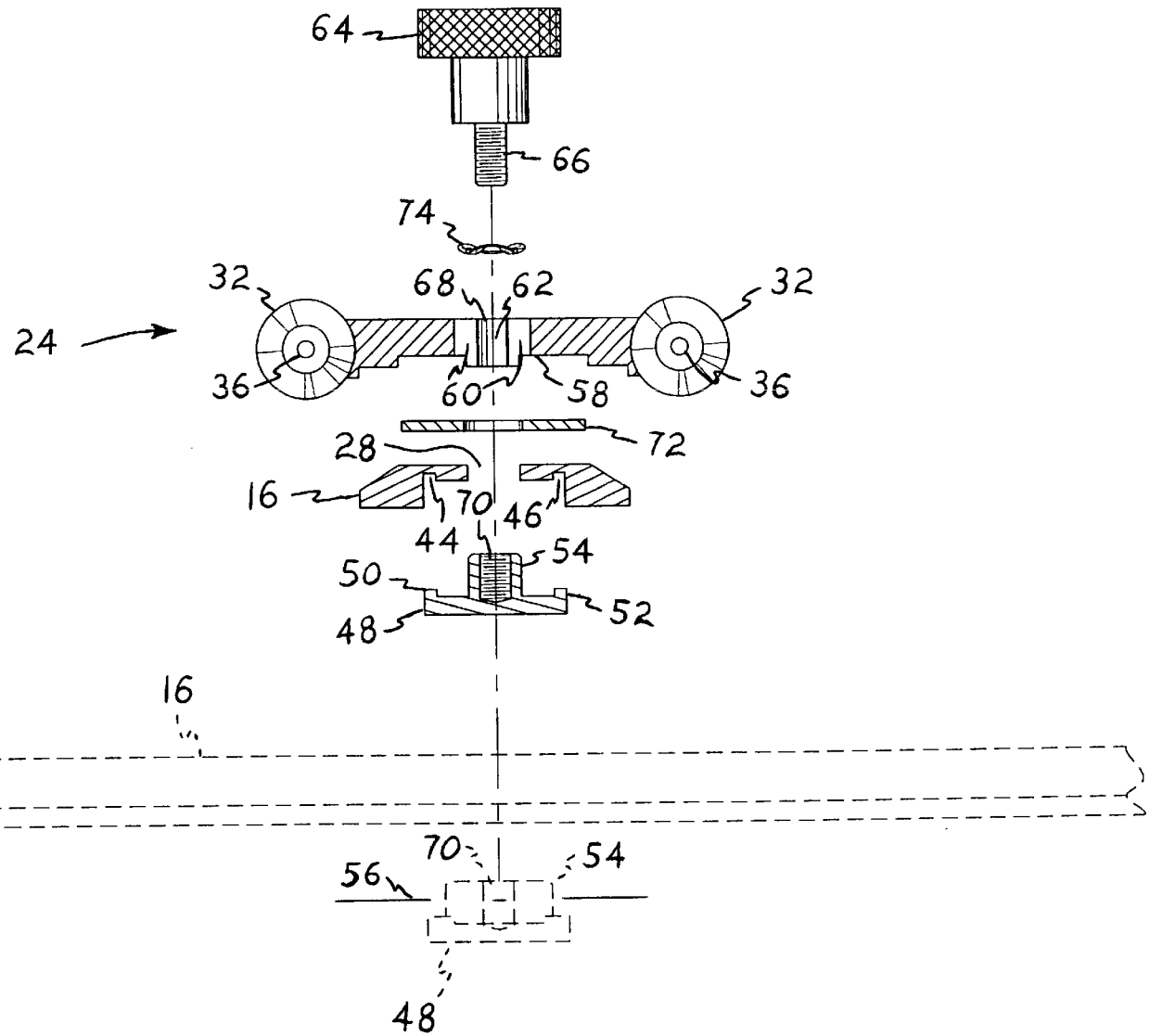
FIG. 3 is an exploded elevation view in section of the cutting head of the present tool, showing the relationship of the components thereof.
Figure 4:
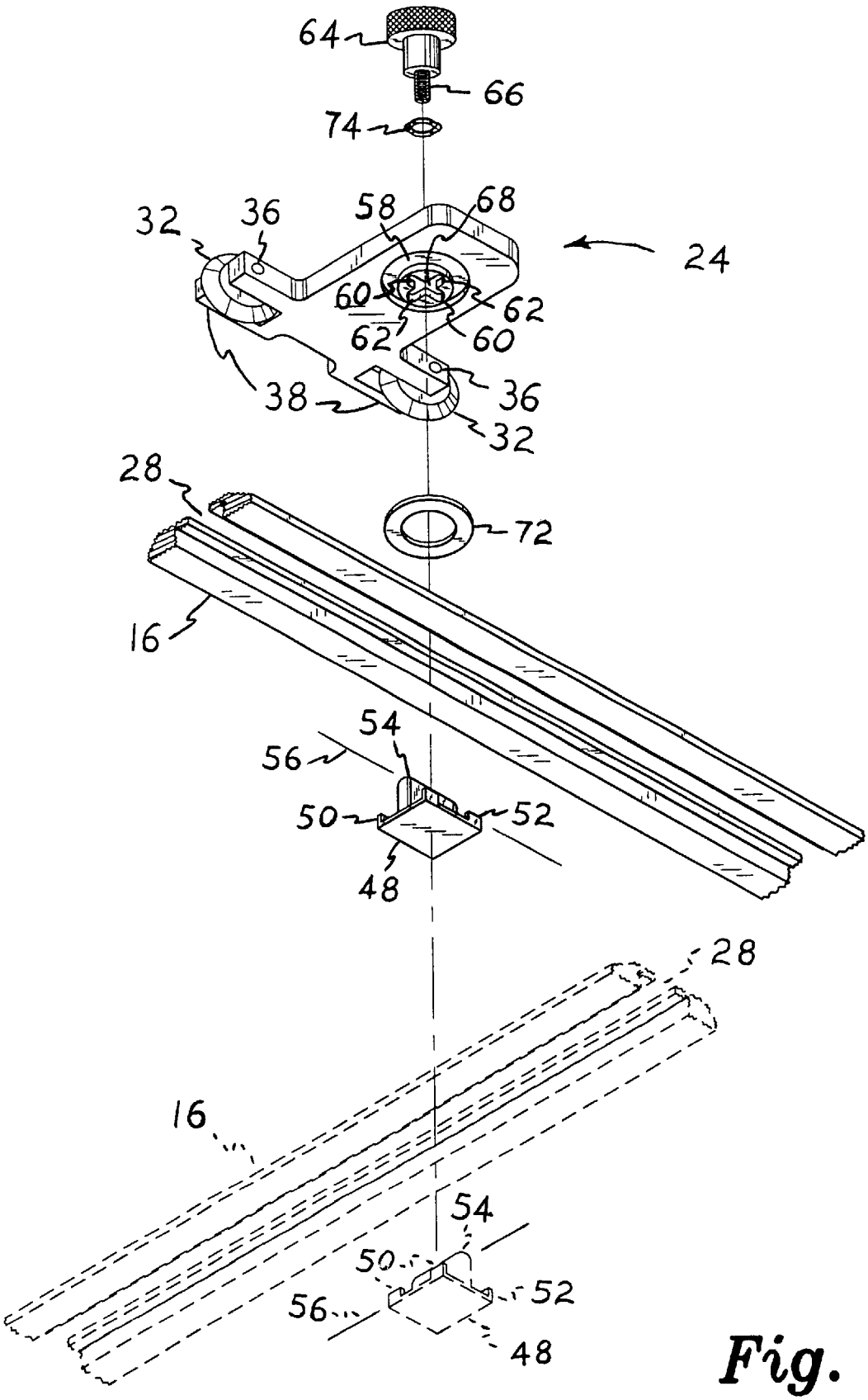
FIG. 4 is an exploded perspective view of the present tool, showing further details of the relationship of the components and their alternative assemblies.

FIGS. 3 and 4 illustrate the means providing for adjustably attaching the cutting body 24 to the stem or blade 16, as desired. The attachment means permit the cutting body 24 to be removably affixed to the stem 16 in one of two mutually perpendicular orientations, with the cutting elements 32 and their cutting plane aligned parallel to either the first cutting line 40 and to the stem 16 as shown in FIG. 1 of the drawings, or parallel to the second cutting line 42 and perpendicular to the stem 16 as shown in FIG. 2.

The lower or bottom surface 20 of the stem 16 includes a first and an opposite second channel, respectively 44 and 46, disposed symmetrically to each side of the central slot 28. A slide 48 includes first and second guides, respectively 50 and 52, which engaging the respective channels 44 and 46 of the stem 16, with the channel and guide engagement fixing the slide 48 angularly relative to the stem 16 and precluding rotary motion of the slide 48 relative to the stem 16.

However, it will be seen that the slide 48 is free to move longitudinally along the stem 16, by means of the central extension 54 protruding from the slide 48 between the two guides 50 and 52. The central extension 54 is oval shaped, having flattened sides which bear against the walls of the slot 28 within the stem 16 and define a major axis 56 which is parallel to the slot 28 of the stem 16 when the slide 48 is installed therein. The ovoid shape of the central extension and its close fit within the slot 28 of the stem 16 also precludes rotation of the slide 48 relative to the stem 16.

The cutting body 24 includes a four lobed depression 58 formed centrally therethrough, with first and second lobe pairs, respectively 60 and 62, oriented parallel and perpendicular to the cutting plane defined by the two cutting blades 32. Thus, the ovoid extension 54 of the slide 48 may be inserted through the slot 28 of the stem 16 and into either the first lobe pair 60 or the second lobe pair 62, to lock the cutting body 24 with its cutting elements 32 and their cutting plane oriented parallel to one of the two cutting lines 40 or 42, as desired.

The cutting body 24 is adjustably and removably secured to the stem 16 of the square 12 by a locking adjuster knob 64 which has a threaded screw 66 extending therefrom. The screw 66 is inserted through a central passage 68 through the lobed depression 58 of the cutting body 24, and engages a threaded passage 70 formed centrally in the ovoid slide extension 54. The two passages 68 and 70 will be seen to be concentrically disposed when the cutting body 24 and guides 50 and 52 are assembled upon the stem 16 of the tool 10, with the relatively wide knob 64 and slide 48 sandwiching the cutting body 24 and stem 16 therebetween when the components are assembled. An additional non-metallic friction washer 72 is also installed within the depression 58 beneath the cutting body 24, to bear against the top of the stem or blade 16 for adjustment of the sliding force of the cutting body 24 along the stem 16 as desired. A Bellville or "wavy" washer 74 may be placed upon the threaded screw 66 of the friction knob 64, for further adjustment of the pressure and corresponding friction between the slide 48 and cutting body 24 and the stem or blade 16 sandwiched therebetween.

The above described structure of the present drywall cutting tool 10 enables the tool 10 to be used for forming cuts in drywall sheets S, either parallel or perpendicular to a reference edge R of the sheet S, as desired. For making a cut line 40 perpendicular to the reference edge R of the sheet S, as shown in FIG. 1 of the drawings, the tool is assembled as illustrated in solid lines in FIG. 4 of the drawings, with the cutting elements 32 extending parallel to the stem or blade element 16 of the T square 12. The adjusting knob 64 is tightened only sufficiently to ensure that the assembly remains together, without producing a tight clamping pressure on the stem 16 sandwiched between the cutting body 24 and slide 48. The slide 48 is precluded from turning relative to the T square stem 16 by means of the guides 50 and 52 and their engagement with the channels 44 and 46 of the stem 16, as well as the fact that the elongate slide extension 54 cannot rotate within the slot 28 of the stem or blade 16. However, the cutting body assembly 24 may be slid along the length of the stem or blade 16, as indicated by the movement arrow A2, while the head 14 of the T square 12 is held stationary along the reference edge R of the drywall sheet S. The laterally offset cutting elements 32 will thus produce a cut line 40 perpendicular to the reference edge R of the sheet S and parallel to the stem 16, as shown in FIG. 1.

When a cut along the length of the sheet S is desired, i.e., parallel to the reference edge R, the cutting body 24 is loosened from its attachment to the T square stem 16, and the first lobes 60 of the central depression 58 are disengaged from the elongate slide extension 54 riding within the slot 28 of the stem 16. The cutting body 24 is turned 90 degrees and secured to the stem 16, with this relationship being shown by the broken line orientation of the slide 48 and stem 16 in FIG. 4 of the drawings. The cutting body 24 is tightened securely to the stem 16 to preclude relative movement, and the head 14 of the square 12 and remaining tool 10 are slid along the reference edge R of the sheet S to produce a cut line 42 as shown in FIG. 2.

In summary, the present drywall cutting tool provides exceptional versatility for cutting and forming drywall sheets in the building construction trades. The present tool enables workers to lay out a cut line by means of the graduated scale of the T square stem, and to make a cut either parallel or perpendicular to a reference edge of the drywall sheet, as desired. The stem of the square need only extend to the minor dimension or width of the sheet (i.e., four feet, for conventional four by eight foot panels), as an eight foot long cut may be made by sliding the entire tool along the length of the sheet by means of the T square head bearing slidingly along the long reference edge of the sheet. Yet, shorter cuts are made just as easily, by placing the tool along the reference edge of the sheet so the cutting elements define a cutting line along the line to be cut, and holding the T square portion of the tool immobile while moving the cutting body along the stem of the square. The present tool thus provides great versatility for cutting and scoring drywall panels, and will be much appreciated by those in the trade.

It is to be understood that the present invention is not limited to the sole embodiment described above, but encompasses any and all embodiments within the scope of the following claims.

We claim:

1. A drywall cutting tool, comprising:

a T square portion having a crossmember and an elongate stem normal to and depending from said crossmember;

said stem having a bottom surface, and said crossmember having a guide edge depending below said bottom surface of said stem for engaging a reference edge of a drywall sheet of material;

said stem having a center with an elongate slot formed therethrough;

a cutting body removably and adjustably attachable to said stem by means of said elongate slot;

said cutting body including at least one drywall cutting element depending therefrom, with said at least one drywall cutting element defining a cutting plane;

said stem and said cutting body including means for selectively and adjustably affixing said cutting body to said stem with said cutting plane aligned parallel to one of two cutting lines;

said cutting lines comprising a first cutting line parallel to said stem and a second cutting line perpendicular to said stem;

first and second channels formed in said bottom surface of said stem and disposed symmetrically about said elongate slot of said stem;

a slide having first and second guides for fitting respectively within said first and second channels of said stem so that said slide is angularly fixed relative to said stem;

said slide including a centrally disposed ovoid extension having a major axis aligned with said slot of said stem;

said cutting body having a four lobed depression formed therein for engaging said extension of said slide in one of two mutually normal orientations for orienting said cutting plane along one said cutting line as desired;

said depression of said cutting body and said extension of said slide each having a passage formed therethrough, with each said passage being concentrically disposed when said cutting body and said slide are assembled on said stem;

said passage of said slide being threaded; and a locking adjuster knob having a threaded screw extending therefrom and engaging said threaded passage of said slide, and sandwiching said cutting body and said stem between said knob and said slide for adjustably securing said cutting body to said slide.

2. The drywall cutting tool according to claim 1, wherein said at least one drywall cutting element further comprises a pair of cutting elements defining a single cutting plane.

3. The drywall cutting tool according to claim 2, wherein said pair of cutting elements further comprise rotary cutting blades.

4. The drywall cutting tool according to claim 2, wherein said pair of cutting elements are laterally offset from said cutting body and said stem when said cutting elements define a cutting plane parallel to said stem.

5. The drywall cutting tool according to claim 2, wherein each of said cutting elements is widely spaced from the other by a span greater than said width of said stem, with one of said cutting elements being disposed to each side of said stem and with said cutting body straddling said stem when said cutting elements define a cutting plane perpendicular to said stem.

6. The drywall cutting tool according to claim 1, wherein said crossmember and said stem are permanently and immovably affixed to one another.

7. The drywall cutting tool according to claim 1, further including graduation marks for measurement disposed along at least said stem.

8. A drywall cutting tool, comprising:

a T square portion having a crossmember and an elongate stem normal to and depending from said crossmember;

said stem having a bottom surface, and said crossmember having a guide edge depending below said bottom surface of said stem for engaging a reference edge of a drywall sheet of material;

said stem having a width and a center with an elongate slot formed therethrough;

a cutting body removably and adjustably attachable to said stem by means of said elongate slot;

said cutting body including a first and a second drywall rotary cutting blade depending therefrom, with both said first and said second rotary cutting blade defined in a single cutting plane;

one said cutting blade being disposed to each side of said stem, with said cutting body straddling said stem when said cutting plane is perpendicular to said stem;

said stem and said cutting body further include means for selectively and adjustably affixing said cutting body to said stem with said cutting plane aligned parallel to one of two cutting lines; and said cutting lines further comprising a first cutting line parallel to said stem and a second cutting line perpendicular to said stem.

9. The drywall cutting tool according to claim 8, wherein said means for selectively and adjustably affixing said cutting body to said stem further comprises:

first and second channels formed in said bottom surface of said stem and disposed symmetrically about said elongate slot of said stem;

a slide having first and second guides for fitting respectively within said first and second channels of said stem so that said slide is angularly fixed relative to said stem;

said slide including a centrally disposed ovoid extension having a major axis aligned with said slot of said stem;

said cutting body having a four lobed depression formed therein for engaging said extension of said slide in one of two mutually normal orientations for orienting said cutting plane along one said cutting line as desired;

said depression of said cutting body and said extension of said slide each having a passage formed therethrough, with each said passage being concentrically disposed when said cutting body and said slide are assembled on said stem;

said passage of said slide being threaded; and a locking adjuster knob having a threaded screw extending therefrom and engaging said threaded passage of said slide, and sandwiching said cutting body and said stem between said knob and said slide for adjustably securing said cutting body to said slide.

10. The drywall cutting tool according to claim 8, wherein said pair of cutting elements are laterally offset from said cutting body and said stem when said cutting elements define a cutting plane parallel to said stem.

11. The drywall cutting tool according to claim 8, wherein each of said cutting elements is widely spaced from the other by a span greater than said width of said stem, with one of said cutting elements being disposed to each side of said stem and with said cutting body straddling said stem when said cutting elements define a cutting plane perpendicular to said stem.

12. The drywall cutting tool according to claim 8, wherein said crossmember and said stem are permanently and immovably affixed to one another.

13. The drywall cutting tool according to claim 8, further including graduation marks for measurement disposed along at least said stem.

14. A drywall cutting tool, comprising:

a T square portion having a crossmember and an elongate stem normal to and depending from said crossmember;

said stem having a bottom surface, and said crossmember having a guide edge depending below said bottom surface of said stem for engaging a reference edge of a drywall sheet of material;

said stem having a center with an elongate slot formed therethrough;

a cutting body removably and adjustably attachable to said stem by means of said elongate slot;

said cutting body including a pair of cutting blades depending therefrom, with said pair of cutting blades defining a cutting plane;

said cutting body attached to said stem such that the cutting plane is alternately parallel or perpendicular to said stem;

said stem and said cutting body including means for selectively and adjustably affixing said cutting body to said stem with said cutting plane aligned parallel to one of two cutting lines; and said cutting lines comprising a first cutting line parallel to said stem and a second cutting line perpendicular to said stem.

15. The drywall cutting tool according to claim 14, wherein said cutting blades are rotary cutting blades.

16. The drywall tool according to claim 14, wherein said pair of cutting blades are laterally offset from said cutting body and said stem when said cutting blades define a cutting plane parallel to said stem.

17. The drywall cutting tool according to claim 14, wherein each of said cutting blades is widely spaced from the other by a span greater than said width of said stem, with one of said cutting blades being disposed to each side of said stem and with said cutting body straddling said stem when said cutting blades define a cutting plane perpendicular to said stem.

18. The drywall cutting tool according to claim 14, wherein said crossmember and said stem are permanently and immovably affixed to one another.

19. The drywall cutting tool according to claim 14, further including graduation marks for measurement disposed along at least said stem.

* * * * *